US008765658B2

(12) United States Patent
MacKinnon et al.

(10) Patent No.: US 8,765,658 B2
(45) Date of Patent: Jul. 1, 2014

(54) METHOD FOR MAKING AND USING A STABLE CLEANING COMPOSITION

(75) Inventors: John MacKinnon, Vernon Hills, IL (US); Sheryl Ivy, Oglesby, IL (US)

(73) Assignee: Carus Corporation, Peru, IL (US)

( * ) Notice: Subject to any disclaimer, the term of this patent is extended or adjusted under 35 U.S.C. 154(b) by 71 days.

(21) Appl. No.: 13/612,388

(22) Filed: Sep. 12, 2012

(65) Prior Publication Data

US 2014/0073545 A1 Mar. 13, 2014

(51) Int. Cl.

| | |
|---|---|
| ***C11D 3/39*** | (2006.01) |
| ***C11D 11/00*** | (2006.01) |
| ***C11D 17/00*** | (2006.01) |

(52) U.S. Cl.

CPC ..... *C11D 17/0021* (2013.01); *C11D 11/0041* (2013.01); *C11D 3/3947* (2013.01)

USPC ..... 510/417

(58) Field of Classification Search

CPC ..... C11D 3/3947; C11D 17/0021

USPC ..... 510/417

See application file for complete search history.

(56) References Cited

U.S. PATENT DOCUMENTS

| | | | | |
|---|---|---|---|---|
| 4,541,944 | A * | 9/1985 | Sanderson | 510/371 |
| 5,643,861 | A * | 7/1997 | de Guertechin et al. | 510/365 |
| 5,962,391 | A * | 10/1999 | Oldenhove | 510/369 |
| 7,319,085 | B2 * | 1/2008 | Miracle et al. | 510/286 |
| 7,534,304 | B2 * | 5/2009 | Conrad et al. | 134/10 |
| 2003/0070238 | A1 * | 4/2003 | Radomyselski et al. | 8/137 |
| 2003/0119699 | A1 * | 6/2003 | Miracle et al. | 510/302 |
| 2006/0035799 | A1 * | 2/2006 | Miracle et al. | 510/310 |
| 2007/0082829 | A1 * | 4/2007 | Smets et al. | 510/101 |
| 2008/0020961 | A1 * | 1/2008 | Rodrigues et al. | 510/475 |

* cited by examiner

*Primary Examiner* — Gregory Webb
(74) *Attorney, Agent, or Firm* — Clark Hill PLC

(57) ABSTRACT

A method for preparing an emulsion cleaning composition that is resistant to separation upon exposure to depressed and elevated temperatures and which exhibits a persistent peroxide content comprises preparing an organic portion and an oxidant portion and then combining the organic portion and the oxidant portion under mixing to make the emulsion. The organic portion comprises an organic solvent, and emulsifier and a cleaner surfactant. The oxidant portion comprises an oxidizing compound activator and a peroxide generator. The emulsion cleaning composition is useful for removing petroleum distillate residue from metal surfaces such as refinery surfaces.

19 Claims, No Drawings

METHOD FOR MAKING AND USING A STABLE CLEANING COMPOSITION

FIELD OF THE INVENTION

The subject matter disclosed herein relates to a method for making stabilized cleaning solutions that are of particular utility in cleaning petroleum distillate residue from metal surfaces. Embodiments of the present invention relate to a method for making a stable solution of an organic solvent, such as limonene, a peroxide generator, such as a perborate compound, an emulsifier, a cleaner surfactant and other components, such that the stable solution is useful for cleaning petroleum distillated residue from metal surfaces.

BACKGROUND OF THE INVENTION

Heretofore, stabilized cleaning compositions of oxidizing compounds, organic solvent, an emulsifier, a cleaner surfactant, an oxidizing compound activator and water have not been made such that the composition is stabilized for a period of time sufficient to render the composition suitable for use in cleaning petroleum distillate residue from metal surfaces. In particular, a stabilized cleaning composition which contains oxidizing compounds, organic solvent, an emulsifier, a cleaner surfactant, an oxidizing compound activator and water, and in which the peroxide is stable, persistent and available for a period of days, has not been available in the prior art. Heretofore, the benefits of such a stable cleaning composition have not been available commercially. There are practical and environmental benefits derivable from a stable cleaning composition that contains both water and an organic solvent along with an oxidizing compound, an emulsifier, a cleaner surfactant and an oxidizing compound activator. Therefore, what is needed is method for making a stabilized cleaning composition containing an oxidizing compound, organic solvent, an emulsifier, a cleaner surfactant, an oxidizing compound activator and water such that the stability of the cleaning composition permits its use for cleaning petroleum distillate residue from metal and for other cleaning operations.

Cleaning petroleum distillate residue from metal is a well-known problem. For example, refinery tanks require periodic cleaning to remove petroleum distillate residue from the metal interior of the tanks and other equipment. A variety of products and services are commercially available which attempt to clean refinery tanks in an effective and environmentally safe manner. However, none of the known commercial products provide a stable cleaning composition, that is one that does not over a short period of time separate into layers, which contains an oxidizing compound, organic solvent, an emulsifier, a cleaner surfactant, an oxidizing compound activator and water, and one in which the oxidizing compound, peroxide for example, remains at a sufficiently high concentration for a period of time to render such a product useful.

A common problem with prior art cleaning compositions containing a peroxide generator or compound as a primary functional component, an organic solvent and water, is that the peroxide would too quickly be consumed, thus rendering it unavailable in a cleaning process to which the cleaning composition was applied. Such prior art cleaning compositions therefore tend to be unsuitable for their intended purpose. Thus, what is needed is a method for making a cleaning solution containing oxidizing compounds, organic solvent, an emulsifier, a cleaner surfactant, an oxidizing compound activator and water, and in which peroxide is persistent and stable for period of time such that the cleaning solution may be used for its intended purpose.

Having a stable cleaning composition that contains both an organic solvent and substantial amounts of water is advantageous. Such a composition may offer several benefits over waterless cleaning compositions. The reduced organic content of such a composition makes it environmentally friendlier than waterless compositions. Furthermore, the reduced organic content of such a composition containing water and organic solvent can make it less volatile than some waterless compositions and therefore may be more practical to use. Furthermore, such a cleaning composition may break into bilayers after use, thus making separation of the contaminant-bearing layer easier and reducing or eliminating the need for de-emulsifying agents. The separation into bi-layers should aid wastewater treatment processes into which the contaminant-bearing layer is disposed.

Having a method for making a cleaning composition that contains stable peroxide is a benefit. Such a cleaning composition can potentially be stored prior to use yet remain effective for its intended application. The longer the period of time over which the peroxide content is stable, the less waste of cleaning solution is expected since less cleaning solution with little or no peroxide content would need to be discarded.

SUMMARY OF THE INVENTION

Embodiments of the present invention provide a method by which a stable cleaning composition may be made, which cleaning composition at its point of use contains from about 35 percent by weight water to about 99 percent by weight water and higher. Such a cleaning composition further contains surfactants, an organic solvent and an oxidizing composition. In preferred embodiments, the oxidizing composition is a peroxide compound or a peroxide generator such as sodium perborate. In embodiments of the present invention, a method is provided by which a cleaning composition can be made in which the organic solvent content may range from about 22 weight percent to about 2 weight percent or less depending on the amount of water used.

Embodiments of the present invention provide a method by which a cleaning composition can be made which is a stable emulsion containing an oxidizing compound, organic solvent, an emulsifier, a cleaner surfactant, an oxidizing compound activator, and water, and having a water content of from about 35 weight percent to about 99 weight percent and a ratio of organic solvent to water of from about 5:8 to about 5:85. The emulsions of the methods disclosed herein are stable prior to contact with metal having a refinery waste or petroleum distillate coating for periods of days. The emulsions of the methods disclosed herein are stable when subjected to four freeze/thaw cycles, each for two hours duration. Thus the emulsions of the methods disclosed herein are stable when subjected to a total of eight hours at freezing temperatures (0° C.) and heating at 30° C. for eight hours, alternating between freeze/thaw cycle. Importantly, the peroxide content of the emulsions made by the methods described herein is stable and persistent for periods of up to about 40 days.

DETAILED DESCRIPTION

In the methods of the embodiments of the invention disclosed herein there is provided processes by which stable emulsions are made, which emulsions contain an oxidizing compound, organic solvent, an emulsifier, a cleaner surfactant, an oxidizing compound activator and water. As used herein, the term "emulsion" refers to thermodynamically stable, isotropic liquid mixtures of oil, water and surfactant. Emulsions of the methods disclosed herein are direct emulsions in that they are oil in water emulsions, as will be understood by those of ordinary skill in the art. Furthermore, emulsions of the methods disclosed herein may be microemulsions and the term "emulsion" refers to emulsions and microemulsions as either form may be made by the disclosed methods.

It has been discovered that surprisingly a stable microemulsion useful as a cleaning composition and containing an oxidizing compound, organic solvent, an emulsifier, a cleaner surfactant, an oxidizing compound activator and water may be prepared by providing a first part, hereinafter referred to as the "Organic Portion," and a second part, hereinafter referred to as the "Oxidant Portion," and then mixing the Organic Portion and the Oxidant Portion to make the cleaning composition of the present invention and hereinafter referred to as the "Cleaning Composition," Optionally, Cleaning Compositions made by the methods disclosed herein may include chelants, builders and other conventional cleaning composition components.

The Organic Portion may comprise an organic solvent, an emulsifier and a cleaner surfactant. An example of an organic solvent is d-limonene. Alternately, propylene glycol propylether, ethylene glycol mono-n-butyl ether, or di-propylene glycol propylether may be used in place of or in combination with limonene. An emulsifier, such as DEMULS DLN-2314 available from DeForest Enterprises, Inc. Boca Raton, Fla., is a known organic solvent emulsifier and is useful in Organic Portions used in the methods disclosed herein. A cleaner surfactant, such as Berol-226-SA, available from Akzo Nobel, Monroeville, Pa., is a known cleaner surfactant useful in Organic Portions used in the methods disclosed herein. Cleaner surfactants are generally well known in the detergent formulating art and selection of a suitable cleaner surfactant is within the abilities of persons having ordinary skill in the art.

The Oxidant Portion comprises an oxidizing compound, such as a peroxide compound or a peroxide generator, and water. The Oxidant Portion may include other components, such as an oxidizing compound activator. Common oxidizing compound activators include acetic acid. The Oxidant Portion, as further addressed herein below, may further include a stabilizer, such as monosodium phosphate or sorbitol. One peroxide generator useful in the Oxidant Portions used in the methods disclosed herein is sodium perborate. Sodium percarbonate is another peroxide generator useful in the Oxidant Portions used in the methods disclosed herein.

In a preferred embodiment, an Oxidant Portion and an Organic Portion having similar viscosities and densities are mixed at a 50:50 ratio on a volume basis to make the Cleaning Composition. Making the Cleaning Composition using an Oxidant Portion and an Organic Portion having similar viscosities and similar densities is not critical to the methods disclosed and claimed herein but does facilitate mixing.

Preparing a separate Organic Portion and a separate Oxidant Portion and then mixing the two Portions to make the Cleaning Composition is critical to the methods of the present invention. The amount of mixing time needed to prepare the Cleaning Composition will vary with Portion volume and mixing conditions, as will be understood by those of ordinary skill in the art. Mixing time and conditions adequate to make an emulsion are required.

The cleaning efficacy of a Cleaning Composition prepared according to an embodiment of the methods disclosed herein was determined. An Organic Portion comprising d-limonene, an emulsifier and a cleaner surfactant was prepared. The Organic Portion contained ca. 37.3 percent by weight organic solvent (d-limonene), ca. 52.2 percent by weight emulsifier, and ca. 3.75 percent by weight cleaner surfactants. An Oxidant Portion comprising water, an oxidizing compound activator and a peroxide generator, sodium perborate, was prepared. The Oxidant Portion contained ca. 92.3 percent by weight water, ca. 2.5 percent by weight degreaser and ca. 1.7 percent by weight sodium perborate. Equal volumes of the Organic Portion and the Oxidant Portion were mixed to form a microemulsion Cleaning Composition. An aliquot of the thus prepared Cleaning Composition was then diluted to yield a dilute Cleaning Composition containing ca. 4 percent by weight organic solvent, ca. 0.4 percent by weight sodium perborate and ca. 88.4 percent by weight water. The thus prepared dilute Cleaning Composition is hereinafter referred to as "Cleaning Composition-1" and was then subjected to tests to determine its efficacy as a cleaning composition.

The efficacy of Cleaning Composition-1 as a cleaning composition was determined using prepared coupons which had on their surfaces a baked-on "soil." The "soil" was prepared to approximate refinery residue and comprised acetylene carbon black, cobalt naphthanate and canola oil, which were combined and then baked on metal coupons at 165° C. overnight. The thus prepared coupons were then, upon cooling to room temperature, suspended in an aliquot of Cleaning Composition-1, under mixing, for 6 hours at 65° C. The weight of each coupon tested was measured before and after the coupon was subjected to Cleaning Composition-1, thus allowing a calculation of the percent of "soil" removed by Cleaning Composition-1. The results of the determination of the efficacy of Cleaning Composition-1 as a cleaning composition are provided in Table 1.

TABLE 1

Efficacy Testing of Cleaning Composition-1

| Coupon Number | Percent Soil Removal (w/w) | Age of Dilute Cleaning Composition at Start of Test |
|---|---|---|
| 1 | 50.3 | Freshly Prepared |
| 2 | 75.8 | Freshly Prepared |
| 3 | 86.8 | Freshly Prepared |
| 4 | 81.7 | One Day Old |
| 5 | 91.8 | One Day Old |
| 6 | 92.2 | One Day Old |

Further efficacy testing of Cleaning Compositions prepared according to the methods disclosed herein are presented in Table 2. The Cleaning Compositions referenced in Table 2 were prepared as described above but had different organic solvent, peroxide generator and water contents. The efficacy tests were conducted as described above wherein coupons were suspended in Cleaning Composition, under mixing, for 6 hours at 65° C.

TABLE 2

Further Efficacy Testing of Cleaning Compositions

| Coupon Number | Percent limonene (w/w) | Percent sodium perborate (w/w) | Percent Soil Removal (w/w) |
|---|---|---|---|
| 7 | 5 | 0.1 | 98.7 |
| 8 | 5 | 0.1 | 97.5 |
| 9 | 5 | 0.1 | 80.9 |
| 10 | 6 | 0.2 | 97.8 |
| 11 | 6 | 0.2 | 84.5 |
| 12 | 6 | 0.2 | 98.6 |

An Organic Portion comprising d-limonene, an emulsifier and a cleaner surfactant was prepared. The Organic Portion contained ca. 37.4 percent by weight organic solvent (d-limonene), ca. 52.2 percent by weight emulsifier, and ca. 10.4 percent by weight cleaner surfactant. An Oxidant Portion comprising water, an oxidizing compound activator and a peroxide generator, sodium perborate, was prepared. The Oxidant Portion contained ca. 94 percent by weight water, ca. 2.5 percent by weight degreaser, and ca. 3.5 percent by weight sodium perborate. Equal volumes of the Organic Portion and the Oxidant Portion were mixed to form a microemulsion Cleaning Composition. An aliquot of the thus prepared Cleaning Composition was then diluted to yield a dilute Cleaning Composition containing ca. 5 percent by weight organic solvent, ca. 0.3 percent by weight sodium perborate and ca. 85 percent by weight water. The thus prepared dilute Cleaning Composition, referred to hereinafter as "Cleaning Composition-2," was then subjected to tests to determine its efficacy and stability when subjected to freezing temperatures and exposure for an extended period of time at 30° C.

Coupons with baked-on "soil" were prepared as described herein above. The efficacy of Cleaning Composition-2 was then compared to several commercially available cleaning products. The commercially available products compared to Cleaning Composition-2 were "CC ELIMINATOR," available from Clean Concepts, Inc., Port Ludlow, Wash.; "ENVIROSCRUB C," available from Vapor Technologies, Inc., Hitchcock, Tex.; and "NWT-100," available from Novo World Technologies Inc., Totola, BVI. Aliquots of 120 milliliters each of Cleaning Composition-2 and the above identified commercially available products were placed into separate beakers. Three coupons were suspended in each beaker. Each beaker was then covered with foil and heated to 65° C. for 6 hours with mixing. After the 6 hours immersion, the coupons were removed, washed and dried. The weight of each coupon before immersion and after completion of the test was determined and used to calculate the percentage of "soil" removed during the test. The coupons subjected to Cleaning Composition-2 showed, on average, an 86.71 percent (w/w) removal of "soil." The test coupons immersed in the commercially available products showed the same weight before and after the test.

In testing the stability of Cleaning Composition-2 when exposed to high and low temperatures, 2 milliliters of Cleaning Composition-2 was placed in a 4 dram vial. A vial containing Cleaning Composition-2 was placed in a heat bath for 1 hour at 35° C. The vial was removed from the heat bath after one hour, allowed to cool to room temperature and then placed back into the heat bath for eight hours at 35° C. Upon removal from the second immersion in the heat bath the vial was allowed to cool to room temperature and then examined for appearance of any precipitate or a cloud point. No precipitates or a cloud point were observed in this test. A second vial containing Cleaning Composition-2 was subjected to four freeze/thaw cycles, each for two hours duration. Thus the Cleaning Composition-2 was subjected to a total of eight hours at freezing temperatures (0° C.) and heating at 30° C. for eight hours, alternating between freeze/thaw cycle. Cleaning Composition-2 was then examined for appearance of any precipitate or a cloud point. No precipitates or a cloud point were observed in this test. Thus, Cleaning Compositions made according to the methods disclosed herein are stable and not subject to separation when exposed to either depressed or elevated temperatures.

Cleaning Composition-2 was also tested over time to determine how rapidly the hydrogen peroxide concentration declined. A sample of Cleaning Composition-2 was allowed to stand at room temperature and aliquots were drawn from the sample on a daily basis. Each aliquot was tested to determine the concentration of hydrogen peroxide present in the aliquot using standard test methods well known to those of ordinary skill in the art. Peroxide was determined using QUANTOFIX PEROXIDE 25 STRIPS, available from Macherey-Nagal, Duren Germany. The results of such hydrogen peroxide stability testing are reported in Table 3.

TABLE 3

Hydrogen Peroxide Stability in Cleaning Composition-2

| Day | Hydrogen Peroxide Concentration |
|---|---|
| 1 | >300 ppm |
| 2 | >300 ppm |
| 3 | >300 ppm |
| 4 | 200 ppm |
| 8 | 200 ppm |
| 9 | 5 ppm |
| 10 | 5 ppm |
| 15 | 0 ppm |

As demonstrated by the results reported in Table 3, Cleaning Compositions made according to the methods disclosed herein are stable and yield a persistent hydrogen peroxide concentration after many days post manufacture.

An Organic Portion comprising d-limonene, an emulsifier and a cleaner surfactant was prepared. The Organic Portion contained ca. 37.3 percent by weight organic solvent (d-limonene), ca, 52.2 percent by weight emulsifier, and ca. 10.4 percent by weight cleaner surfactant. An Oxidant Portion comprising water, an oxidizing compound activator and a peroxide generator, sodium percarbonate, was prepared. The Oxidant Portion contained ca. 91.7 percent by weight water, ca. 4.93 percent by weight degreaser, and ca. 3.37 percent by weight sodium perborate. Equal volumes of the Organic Portion and the Oxidant Portion were mixed to form a microemulsion Cleaning Composition. An aliquot of the thus prepared Cleaning Composition was then diluted to yield a dilute Cleaning Composition containing ca. 5 percent by weight organic solvent, ca. 0.4 percent by weight sodium perborate and ca. 85 percent by weight water. The thus prepared dilute Cleaning Composition, referred to hereinafter as "Cleaning Composition-3," was then subjected to tests to determine the persistence of hydrogen peroxide over time when compared to modified commercially available products. The commercially available compositions were modified to include a peroxide by adding a volume of the Oxidant Portion made for Cleaning Composition-3 to an equal volume of the commercially available products. Aliquots of Cleaning Composition-3 as well as aliquots of the modified commercially available samples were drawn on a daily basis and tested for hydrogen peroxide using methods well known to those of ordinary skill in the art.

The commercially available cleaning products modified and then tested for hydrogen peroxide content as compared to Cleaning Composition-2 are presented in Table 4. The aliquots were each diluted 1:500 with water prior to testing for hydrogen peroxide unless otherwise noted,

TABLE 4

| Commercially Available Cleaning Products | |
|---|---|
| Trade name: | Available from: |
| "MANGO BLUE" (DTChem 3025) | Delta Tech Service, Inc., Benicia, CA |
| "CC ELIMINATOR" | Clean Concepts, Inc., Port Ludlow, WA |
| "SULFUR SCRUB C" ("ENVIROSCRUB VT") | Vapor Technologies, Inc., Hitchcock, TX |
| "NWT-100" | Novo World Technologies Inc., Tortola, BVI |
| "JPX" | Jayne Products Inc., Carson, CA |
| "SMART SOLVE" | United Laboratories, Inc., St. Charles, IL |

The results of testing for the content, or persistence, of hydrogen peroxide in Cleaning Composition-3 as compared to the modified commercially available cleaning products identified in Table 4 are presented in Table 5.

TABLE 5

| Hydrogen Peroxide Persistence: Cleaning Composition-3 and Others | | | | | | |
|---|---|---|---|---|---|---|
| Sample* | Day: 0 | Day: 1 | Day: 2 | Day: 3 | Day: 6 | Day: 7 |
| | $H_2O_2$ Content | | | | | |
| Chemical Composition-3 | 10 mg/l** | 2 mg/l | 25 mg/l*** | 5 mg/l*** | 0 | 0 |
| MANGO BLUE | 25 mg/l | 10 mg/l | 10 mg/l | 10 mg/l | 10 mg/l | 10 mg/l |
| CC ELIMINATOR | 25 mg/l | 10 mg/l | 10 mg/l | 10 mg/l | 10 mg/l | 10 mg/l |
| SULFUR SCRUB C | 0 | 0 | | | | |
| NWT-100 | 25 mg/l | 10 mg/l | 10 mg/l | 10 mg/l | 10 mg/l | 10 mg/l |
| JPX**** | 25 mg/l | 25 mg/l | 25 mg/l | 25 mg/l | 25 mg/l | 10 mg/l |
| SMART SOLVE**** | 25 mg/l | 10 mg/l | 10 mg/l | 10 mg/l | 10 mg/l | 10 mg/l |

*commercially available products were modified by the addition of the Oxidant Portion
**mg/l = milligrams per liter
***sample was diluted 1:25 with water as opposed to 1:500
****samples were bi-layers upon addition of the Oxidant Portion An Organic Portion comprising d-limonene, an emulsifier and a cleaner surfactant was prepared. The Organic Portion contained ea, 37.3 percent by weight organic solvent (d-limonene), ca. 52.2 percent by weight emulsifier, and ca. 10.4 percent by weight cleaner surfactant. An Oxidant Portion comprising water, an oxidizing compound activator and a peroxide generator, sodium percarbonate, was prepared. The Oxidant Portion contained ca. 93.3 percent by weight water, ea, 3.35 percent by weight degreaser, and ca. 3.35 percent by weight sodium percarbonate. Equal volumes of the Organic Portion and the Oxidant Portion were mixed to form a microemulsion Cleaning Composition. An aliquot of the thus prepared Cleaning Composition was then diluted to yield a dilute Cleaning Composition containing ca. 5 percent by weight organic solvent, ca. 0.4 percent by weight sodium percarbonate and ea, 85 percent by weight water. The thus prepared dilute Cleaning Composition, referred to hereinafter as "Cleaning Composition-4," was then subjected to tests to determine the persistence of hydrogen peroxide over time when compared to modified commercially available products. The commercially available compositions were modified to include a peroxide by adding a volume of the Oxidant Portion made for Cleaning Composition-4 to an equal volume of the commercially available products. Aliquots of Cleaning Composition-4 as well as aliquots of the modified commercially available samples were drawn on a daily basis and tested for hydrogen peroxide using methods well known to those of ordinary skill in the art. The aliquots were not diluted with water prior to testing for hydrogen peroxide. The results of testing for the content, or persistence, of hydrogen peroxide in Cleaning Composition-4 as compared to the modified commercially available cleaning products identified in Table 4 are presented in Table 6.

TABLE 6

| Hydrogen Peroxide Persistence: Cleaning Composition-4 and Others | | | | | | |
|---|---|---|---|---|---|---|
| Sample* | Day: 0 | Day: 1 | Day: 2 | Day: 3 | Day: 6 | Day: 7 |
| | $H_2O_2$ Content | | | | | |
| Chemical Composition-4 | 25 mg/l** | 0 | 0 | 0 | 0 | 0 |
| MANGO BLUE | 2 to 5 mg/l | 2 mg/l | 2 mg/l | 2 mg/l | 2 mg/l | 2 mg/l |
| CC ELIMINATOR | 2 to 5 mg/l | 25 mg/l | 25 mg/l | 25 mg/l | 25 mg/l | 25 mg/l |
| SULFUR SCRUB C | 0 | 0 | | | | |
| NWT-100 | 5 to 10 mg/l | 5 to 10 mg/l | 5 to 10 mg/l | 10 mg/l | 10 mg/l | 10 mg/l |
| JPX | 5 to 10 mg/l | 10 mg/l | 10 mg/l | 10 mg/l | 10 mg/l | 10 mg/l |
| SMART SOLVER | 2 mg/l | 2 mg/l | 2 mg/l | 2 mg/l | 5 mg/l | 5 mg/l |

*commercially available products were modified by the addition of the Oxidant Portion
**mg/l = milligrams per liter Cleaning Compositions may break into bi-layers after use, thus making separation of the contaminant-bearing layer easier and reducing or eliminating the need for de-emulsifying agents. The separation into hi-layers should aid wastewater treatment processes into which the contaminant-bearing layer is disposed.

Cleaning Compositions made according to the methods of the present invention may be further stabilized by the addition of monosodium phosphate or a combination of monosodium phosphate and sorbitol, in an amount which does not destabilize the Cleaning Composition emulsion. The addition of such a stabilizer results in Cleaning Composition which exhibit surprisingly long peroxide persistence times. Table 7, presented below, describes Cleaning Compositions made using such a modified method comprising the further addition of a stabilizer.

TABLE 7

Cleaning Compositions Made Using the Optional Step of Adding a Stabilizer

| | For Control Used in Cleaning Composition-5 |
|---|---|
| Organic Portion | |
| DLN-2314 emulsifier | 24.2% w/w |
| d-limonene | 17.3% w/w |
| surfactant | 4.9% w/w |
| Oxidant Portion | |
| acetic acid | 0.8% w/w |
| sodium perborate | 1.4% w/w |
| water | 49.9% w/w |
| | For monosodium phosphate modified composition Used in Cleaning Composition-6 |
| Organic Portion | |
| DLN-2314 emulsifier | 24.2% w/w |
| d-limonene | 17.3% w/w |
| Surfactant | 4.9% w/w |
| Oxidant Portion | |
| acetic acid | 0.8% w/w |
| sodium perborate | 1.4% w/w |
| monosodium phosphate | 1.4% w/w |
| water | 49.9% w/w |
| | For monosodium phosphate and sorbitol modified composition Used in Cleaning Composition-7 |
| Organic Portion | |
| DLN-2314 | emulsifier 24.2 wt. % |
| limonene | solvent 17.3 wt. % |
| surfactant | surfactant 4.9% w/w |
| Oxidant Portion | |
| acetic acid | 0.8% w/w |
| sodium perborate | 1.4% w/w |
| monosodium phosphate | 1.4% w/w |
| d-sorbitol | 1.4% w/w |
| water | 49.9% w/w |

For example, a Cleaning Composition prepared according to the methods disclosed herein and which contained monosodium phosphate was prepared and is identified hereinafter as "Cleaning Composition-6." An Oxidant Portion was prepared as described in Table-7. To the thus prepared Oxidant Portion, 1.4 percent by weight of monosodium phosphate was added. An Organic Portion was prepared as described in Table-7. Equal volumetric Portions of the thus prepared Oxidant Portion and Organic Portion were then combined to make Cleaning Composition-6. Similarly, a cleaning composition was prepared, hereinafter referred to as "(leaning Composition-7," as described above by mixing equal volumetric portions of the Oxidant Portion and the Organic Portion described in Table-7. A control, which did not include the addition of either monosodium phosphate or monosodium phosphate plus sorbitol, was prepared as described in Table-7, and thereafter by mixing equal volumetric portions of the thus prepared Oxidant Portion and Organic Portion. Diluted samples of Cleaning Compositions 5 through 7 were also prepared by mixing the corresponding Cleaning Composition 50:50 V/V with water. Both the undiluted and diluted Cleaning Compositions 5 through 7 were then subjected to storage at 45° C.

Periodically, during storage at 45° C., aliquots of each of the thus prepared Cleaning Compositions 5 through 7 and their diluted counterparts were taken and the hydrogen peroxide content of each aliquot was determined. The following Table-8 presents the results of measuring the hydrogen peroxide content.

TABLE 8

Hydrogen Peroxide Content for Cleaning Compositions 5-7

| Cleaning Composition Day | $H_2O_2$ (ppm) | | | | | | | | |
|---|---|---|---|---|---|---|---|---|---|
| ⟹ | 0 | 5 | 10 | 15 | 20 | 25 | 30 | 35 | 40 |
| 5 | 12500 | 5000 | 4100 | 2100 | 1900 | 1900 | 0 | 0 | 0 |
| 6 | 12500 | 12500 | 12500 | 12500 | 12500 | 5000 | 2000 | 1000 | 500 |
| 7 | 12500 | 12500 | 12500 | 10000 | 5000 | 2000 | 1800 | 900 | 250 |
| 5 Diluted | 12500 | 5000 | 5000 | 900 | 900 | 100 | 0 | 0 | 0 |
| 6 Diluted | 12500 | 12500 | 12500 | 12500 | 11500 | 11500 | 5000 | 4100 | 1000 |
| 7 Diluted | 12500 | 12500 | 12500 | 12500 | 5000 | 2000 | 400 | 200 | 0 |

Thus, an optional step in the methods disclosed herein is the addition of a stabilizer to an Oxidant Portion prior to combining the Oxidant Portion and an Organic Portion. Surprisingly, upon addition of either monosodium phosphate or monosodium phosphate plus sorbitol, the time of hydrogen peroxide persistence is greatly increased over that which exists when such a stabilizer is not used.

Accordingly, it has been demonstrated that Cleaning Compositions made according to the methods described herein contain persistent hydrogen peroxide content.

Embodiments of the present invention provide a method by which a stable cleaning composition may be made, which cleaning composition at its point of use contains from about 35 percent by weight water to about 99 percent by weight water. Such a cleaning composition further contains cleaner surfactants, an organic solvent, an emulsifier, degreaser, and an oxidizing composition. The oxidizing composition can be a peroxide compound or a peroxide generator such as sodium perborate, but other peroxide generators such as sodium percarbonate may be used. In embodiments of the present invention, a method is provided by which a cleaning composition can be made in which the organic solvent content may range from about 22 weight percent to about 2 weight percent depending on the amount of water used.

Embodiments of the present invention further provide a method by which a cleaning composition may be made which is a stable microemulsion having a water content of from about 35 weight percent to about 99 weight percent and a ratio of organic solvent to water of from about 5:8 to about 5:85. The emulsions of the methods disclosed herein are stable prior to contact with metal having a refinery waste or petroleum distillate coating for periods of from about one day to about ten days. The emulsions of the methods disclosed herein are stable when subjected to four freeze/thaw cycles, each for two hours duration. Thus the Cleaning Composition-2 was subjected to a total of eight hours at freezing temperatures (0° C.) and heating at 30° C. for eight hours, alternating between freeze/thaw cycles. Importantly, the peroxide content of the emulsions made by the methods described herein may be stable and persistent for periods of from about one day to about 40 days.

In application, an Organic Portion and an Oxidant Portion are separately prepared in advance of the time the Cleaning Composition will be put to use. The Organic Portion and Oxidant Portion are prepared as described herein. In a suitable vessel, typically near the location where the cleaning is to be done, the Organic Portion and the Oxidant Portion are combined under mixing to a microemulsion which is the Cleaning Composition of the present invention. The Cleaning Composition may then be sprayed, wiped or brushed onto the surface to be Cleaned. For example, if a refinery tank is to be cleaned, then a dilution of the Cleaning Composition of the present invention may be made using 0.1 percent (w/w) Cleaning Composition and 99.9 percent (w/w water). The thus diluted Cleaning Composition may then be applied to the refinery tank by spraying it on the surface of the refinery tank at room temperature. Alternately, the diluted Cleaning Composition may be sprayed on the surface of the refinery tank and, optionally, with the application of steam. Pressures within the refinery tank may be maintained at atmospheric pressure or higher, to aid cleaning. The diluted Cleaning Composition may be recycled and monitored for oxidant concentration to deter nine when the cleaning process is complete.

It will be appreciated by persons skilled in the art that the present have on is not limited by what has been particularly shown and described herein. Rather, the scope of the present invention is defined only by the claims which follow.

What is claimed is:

1. A method for preparing an emulsion that is a stable cleaning solution, the cleaning solution comprising an organic solvent, an emulsifier, a cleaner surfactant, water, and a peroxide generator, the method comprising:

preparing an organic portion by mixing together the organic solvent, the emulsifier and the cleaner surfactant;

preparing an oxidant portion by mixing together the water, an oxidizin compound activator and the peroxide generator; and combining the organic portion and the oxidant portion under mixing to make the emulsion;

wherein the emulsion exhibits a hydrogen peroxide content at least one day after the emulsion is prepared.

2. The method of claim 1 wherein the emulsion does not separate into its constituent portions upon exposure to four freeze/thaw cycles, each cycle being two hours in duration, wherein the freeze temperature is about 0° C. and the thaw temperature is about 30° C.

3. The method of claim 1 wherein the peroxide generator is selected from the group consisting of sodium perborate and sodium percarbonate.

4. The method of claim 1 wherein the oxidizing compound activator is acetic acid.

5. The method of claim 1 wherein the emulsifier is an organic solvent emulsifier.

6. A method for cleaning refinery surfaces of petroleum distillate residue, the method comprising:

preparing an organic portion by mixing together an organic solvent, an emulsifier and a cleaner surfactant;

preparing an oxidant portion by mixing together water, an oxidizing compound activator and a peroxide generator;

combining the organic portion and the oxidant portion under mixing to make an emulsion; and applying the emulsion to the refinery surface to be cleaned.

7. The method of claim 6 wherein the emulsion does not separate into its constituent portions when subjected to four freeze/thaw cycles, each cycle being two hours in duration, wherein the freeze temperature is 0° C. and the thaw temperature is 30° C.

8. The method of claim 6 wherein the peroxide generator is selected from the group consisting of sodium perborate and sodium percarbonate.

9. The method of claim 6 wherein the oxidizing compound activator is acetic acid.

10. The method of claim 6 wherein the emulsifier is a an organic solvent emulsifier.

11. A method for preparing an emulsion that is a stable cleaning solution, the cleaning solution comprising an organic solvent, an emulsifier, a cleaner surfactant, water, and a peroxide generator, the method comprising:

preparing an organic portion by mixing together the organic solvent, the emulsifier and the cleaner surfactant;

preparing an oxidant portion by mixing together the water, an oxidizing compound activator and the peroxide generator;

adding to the oxidant portion a stabilizer; and combining the organic portion and the oxidant portion under mixing to make the emulsion;

wherein the emulsion exhibits a hydrogen peroxide content at least forty days after the emulsion is prepared.

12. The method of claim 11 wherein the stabilizer is selected from the group consisting of monosodium phosphate, sorbitol and combinations thereof.

13. The method of claim 11 wherein the stabilizer is added in an amount which does not destabilize the emulsion.

14. The method of claim 11 wherein the peroxide generator is selected from the group consisting of sodium perborate and sodium percarbonate.

15. The method of claim 11 wherein the oxidizing compound activator is acetic acid.

16. The method of claim 11 wherein the emulsifier is a an organic solvent emulsifier.

17. The method of claim 4 wherein the acetic acid concentration is at least 0.8% w/w.

18. The method of claim 9 wherein the acetic acid concentration is at least 0.8% w/w.

19. The method of claim 15 wherein the acetic acid concentration is at least 0.8% w/w.

* * * * *